United States Patent [19]

Rollins et al.

[11] 4,015,751

[45] Apr. 5, 1977

[54] QUICK CHANGE FLUIDIZING OUTLET ASSEMBLY

[75] Inventors: Dallas W. Rollins; Robert W. Randolph, both of St. Charles; Gerald D. Garner, Florissant, all of Mo.

[73] Assignee: ACF Industries, Incorporated, New York, N.Y.

[22] Filed: July 2, 1975

[21] Appl. No.: 592,500

[52] U.S. Cl. ..... 222/195; 55/385 R; 55/481; 55/502; 55/501; 302/52

[51] Int. Cl.[2] ..... B65G 69/06

[58] Field of Search ..... 55/385 R, 476, 481, 55/501, 502, 505, 506, 523, 528; 222/195; 302/52–54

[56] References Cited

UNITED STATES PATENTS

| | | | |
|---|---|---|---|
| 1,598,097 | 8/1926 | Mathis | 55/505 X |
| 2,220,641 | 11/1940 | Davis | 55/523 X |
| 2,459,802 | 1/1949 | Fleisher | 55/501 |
| 2,609,125 | 9/1952 | Schemm | 222/195 |
| 2,969,038 | 5/1961 | Neumann | 55/502 |
| 3,009,607 | 11/1961 | Sayre | 222/195 |
| 3,367,724 | 2/1968 | Emery et al. | 222/195 X |
| 3,430,771 | 3/1969 | Dreher | 55/501 X |
| 3,520,416 | 7/1970 | Keedwell | 55/528 X |
| 3,659,752 | 5/1972 | Carney, Jr. et al. | 222/195 |
| 3,708,209 | 1/1973 | Dugge | 302/52 |
| 3,747,772 | 7/1973 | Brown | 55/501 X |

*Primary Examiner*—Frank W. Lutter
*Assistant Examiner*—David L. Lacey
*Attorney, Agent, or Firm*—Henry W. Cummings

[57] ABSTRACT

A fluidizing assembly is provided having a readily removable and replaceable filter assembly. The filter assembly comprises a supporting grid member, a filter member and an open frame member upon which may be mounted a seal member. The fluidizing outlet assembly comprises an outlet body having a lower body flange and a bottom pan having an upper pan flange spaced below the lower body flange. A pair of filter assemblies are inserted between the lower body flange and the upper pan flange, and engages a filter support assembly located above a fluidizing header in the mid-portion of the outlet. Preferably the filter support assembly is provided with raised surfaces for forcing the filter assembly into operative position. The bottom pan includes passages in fluid communication with the fluidizing header which define a plenum for directing the fluidizing air below the filter member, and supports for the filter member. The bottom pan thus may comprise generally vertical plates integrally affixed to the upper surface of the pan; or more preferably, the pan may comprise corrugations which support the filter and define the plenum for fluidizing air.

13 Claims, 15 Drawing Figures

QUICK CHANGE FLUIDIZING OUTLET ASSEMBLY

BACKGROUND OF THE INVENTION

This invention relates to discharge of fluidizable ladings from containers including but not limited to transportion type containers, overland trucks and railway hopper cars by pneumatic or gravity discharge.

In U.S. Pat. No. 3,659,752 a readily removable permeable filter member is disclosed which is utilized to fluidize the lading and then discharge the same from a railway hopper car or other hopper type containers. However, the complete outlet must be removed from its hopper and disassembled in which a number of fastening bolts must be removed to remove the permeable member in this construction. Thus considerable operator time is required for this operation, and at least in the case of a railway hopper car downtime of the car or unloading system may be required to change the permeable member.

This problem is compounded when the permeable member is contaminated by an air supply system which clogs the permeable member during fluidization from the side opposite the lading. With such contaminated supply air the need to clean and/or replace the permeable member quickly becomes more crucial to maintain efficient unloading rates and prevent damage to the permeable member.

Furthermore, the permeable member disclosed in the said U.S. Pat. No. 3,659,752 patent is expensive. It is desired to reduce the cost of this member, and thus make it more attractive to maintain a clean and efficient membrane.

SUMMARY OF THE INVENTION

It is an object of the present invention to provide a fluidizing outlet assembly having a quick change filter assembly comprising a permeable member.

A fluidizing outlet assembly is provided having a pair of readily removable and replaceable filter assemblies. The filter assemblies comprise a supporting grid member, a filter member and an open frame member upon which may be mounted a seal member. The fluidizing pneumatic outlet comprises an outlet body having a lower body flange and a bottom pan having an upper pan flange spaced below the lower body flange. A pair of filter assemblies are inserted between the upper pan flange and the lower body flange and engages a filter support assembly located above a fluidizing header in the midportion of the outlet. Preferably the filter support assembly is provided with means for forcing the filter assembly into operative engagement with the filter support assembly. The bottom pan includes passage means in communication with the fluidizing header defining a plenum for directing the fluidizing air below the filter member and means for supporting the filter member. The bottom pan thus may comprise generally vertical plates integrally affixed to the upper surface of the pan, or more preferably the pan may comprise corrugations which support the filter and define the plenum for fluidizing air. In one embodiment a sealing means, such as a gasket, is mounted on each filter assembly and means are provided to then raise the filter assembly to compress its gasket to provide a positive seal around its entire periphery preventing bypass of lading material and/or fluidizing air. In another embodiment the sealing means may be applied to the outlet body.

THE DRAWINGS

DESCRIPTION OF PREFERRED EMBODIMENTS

Figure 6:
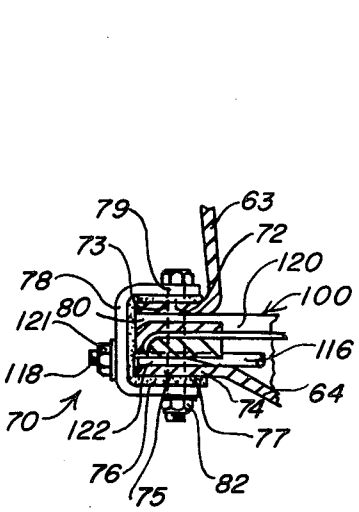
FIG. 6 is a sectional view looking in the direction of the arrows along the line 6—6 in FIG. 2.

The fluidizing outlet assembly is indicated in the drawings generally at 10. Suitable piping indicated generally at 12 is provided to connect the outlet to a source of discharging air. This piping may comprise a piping arrangement as disclosed and claimed in U.S. Pat. No. 3,708,209 which is hereby incorporated into the present application by this reference. Thus a cap 14 is removably affixed to a conduit 16 having a check valve therein 18. A suitable control valve indicated generally at 20 is provided with a controling handle 22 affixed to a vertically extending control shaft 24 (FIG. 4) which, in turn, is affixed to a butterfly valve 26. Preferably the conduit assembly 12 is also provided with another check valve 28 on the outlet side of the control valve 20.

It will be apparent that the air flow divides, one conduit 30 carrying air flow to the pneumatic outlet and another conduit 32 bypassing the pneumatic outlet 50 and joining the pneumatic outlet discharge conduit 34 described in greater detail hereinafter. This discharge conduit comprises a product control valve 36 similar to control valve 26, and a cover assembly 38 including a removable cap 40 and a flexible conduit (not shown) attached to conduit 34 to carry the lading to the container being filled.

Figure 4:
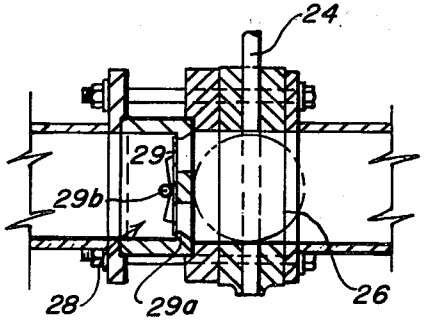
FIG. 4 is a sectional view looking in the direction of the arrows along the line 4—4 in FIG. 1.

As illustrated in FIG. 4, both check valves 18 and 28 may be of generally the same construction having a sealing valve member 29 which seals against flange portion 29*a* of the valve under the bias of a suitable spring 29*b*. Check valve 28 is provided for the purpose of avoiding lading returning through conduit 32 and clogging the operation of butterfly valve 26 and going back further through conduit 30 and contaminating and clogging the permeable member to be described hereinafter. Check valve 18 acts to prevent lading from going back into the air supply system.

Figure 5:
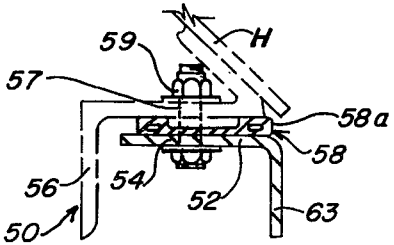
FIG. 5 is a sectional view looking in the direction of the arrows along the line 5—5 in FIG. 2.

The fluidizing outlet assembly of the present invention is illustrated in the drawings at 50. The outlet comprises a mounting flange 52 (FIG. 5) having openings therein 54 to facilitate mounting the outlet upon a suitable hopper H which may be a part of a transportation container, overland truck, industrial bin or a railway hopper car. A mounting member 56 is preferably provided which is integrally affixed to hopper H (for example, by welding) having suitable openings therein 57. Suitable sealing means 58, such as a gasket 58*a*, is provided and suitable fasteners 59 maintain the assembly together.

Figure 3:
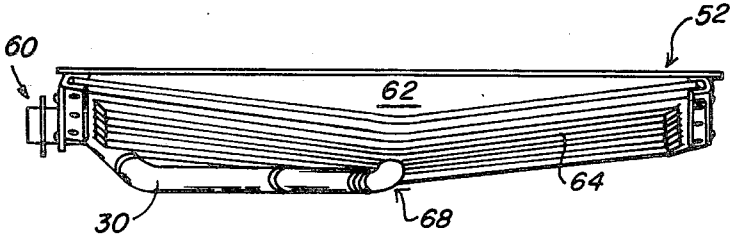
FIG. 3 is a side elevational view looking in the direction of the arrows along the line 3—3 in FIG. 1.
Figure 1:
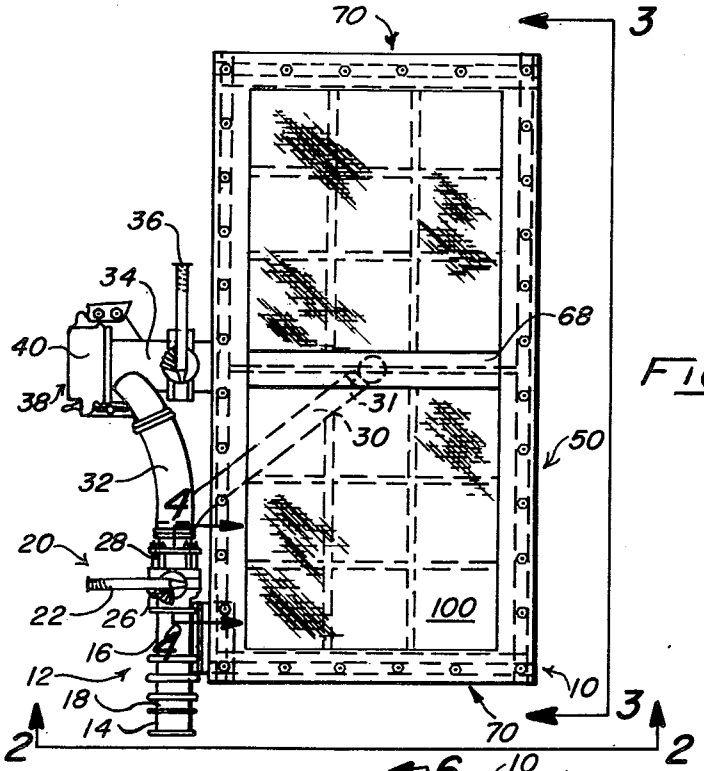
FIG. 1 is a plan view of the fluidizing outlet of the present invention.
Figure 2:
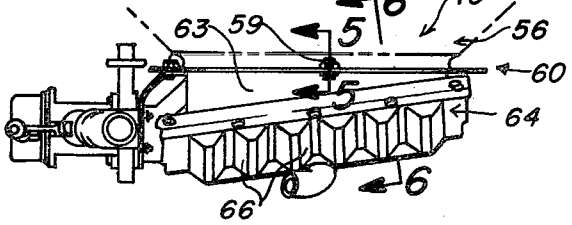
FIG. 2 is an end view looking in the direction of the arrows along the line 2—2 in FIG. 1.
Figure 8:
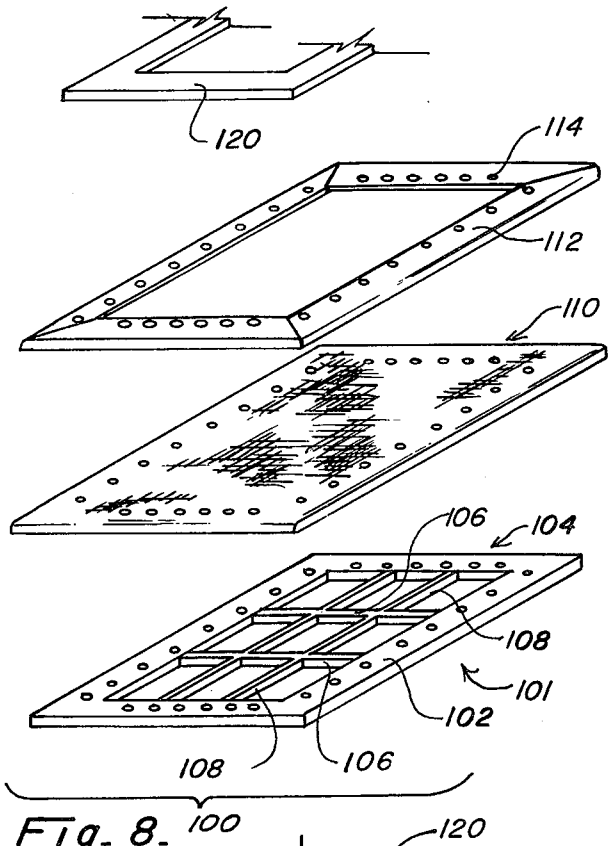
FIG. 8 is an exploded view illustrating the filter assembly of the present invention.
Figure 11:
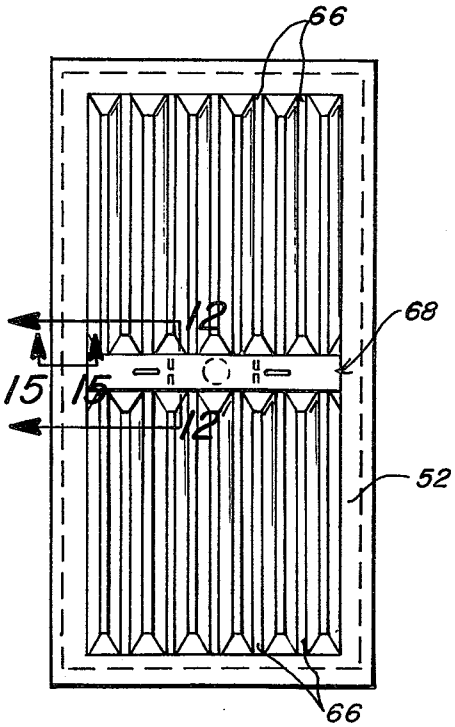
FIG. 11 is a plan view of the outlet bottom pan illustrating the corrugated construction.

Integral with mounting flange 52 is an outlet body 60 (FIGS. 2 and 3) comprising side walls 62, end walls 63 and an outlet bottom pan 64. In one embodiment bottom pan 64 further comprises a plurality of corrugations 66 which as shown in FIG. 11 extend across the outlet into a fluidizing header assembly 68.

At opposite ends of the outlet a filter insertion assembly indicated generally at 70 is provided. As shown in FIG. 6, this assembly 70 comprises a flange 72 integral with end wall 63 and a flange 74 integral with outlet bottom pan 64. Suitable openings 73 and 75 respectively are provided in these flanges. A seal member 76 having mounting openings therein 77, and a cap 78 having mounting openings therein 79 are provided. Fasteners 80 extend through these openings having suitable fastening heads 82.

Flanges 72 and 74 are spaced apart a suitable distance for the purpose of inserting a removable filter assembly indicated in the drawings generally at 100. As shown in FIGS. 7–10, this filter assembly comprises a lower grid member 101 having a frame 102 and a grid structure indicated at 104 comprising a plurality of grid members 106 and 108 which may run longitudinally and transversely.

A filter media member 110 is also provided. The filter media material should be chemically inert to ladings contemplated for transport and unloading. The filter media should preferably have a permeability from 5 to 15 to allow fluidizing air to pass therethrough while not permitting lading to sift through permeability may be defined as the cubic feet per minute which pass through a one square foot section having a pressure drop of 2 inches of water across the section. This definition of permeability is believed to be standard in the fluidizing pneumatic unloading industry, both insofar as railway cars and industrial bins are concerned. The filter media should be resistant to corrosive environments likely to be encountered where the filter is in use and resistant to any environments that the air supply may have therein. Suitable filter materials include micro-porous plastic materials, such as nylon, polyester or cotton cloth; micro-porous metallic materials, such as sintered metals, including, for example, sintered stainless steel, sintered aluminum, and micro-porous etched metallic materials, to the extent that the size can be effectively controlled.

A mounting frame member 112 is also provided which may, for example, comprise a flat plate, an angle, or other suitable member having series of openings therein 114 through which fasteners 115 pass to maintain this assembly together. Fasteners 115 are preferably countersunk as indicated at 117 (FIG. 9) so that a suitable seal member 120 may be applied to the upper surface of mounting plate 112.

Figure 10:
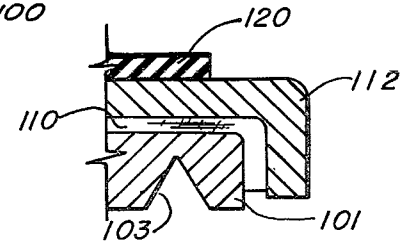
FIG. 10 is a sectional view looking in the direction of the arrows along the line 10—10 in FIG. 7.
Figure 7:
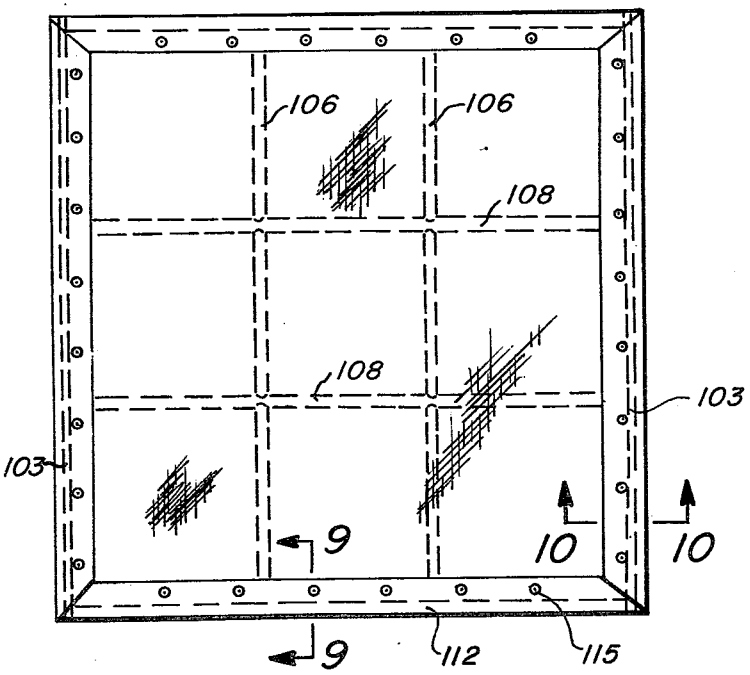
FIG. 7 is a plan view of the removable filter assembly of the present invention.
Figure 9:
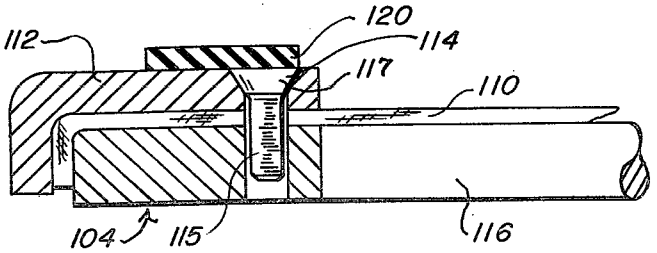
FIG. 9 is a sectional view looking in the direction of the arrows along the line 9—9 in FIG. 7.
Figure 15:
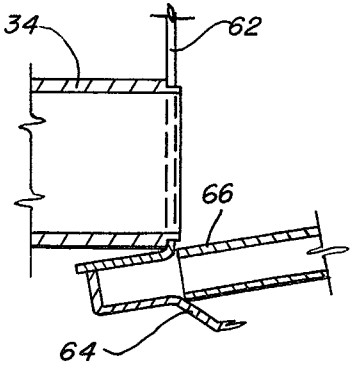
FIG. 15 is a sectional view looking in the direction of the arrows along the line 15—15 in FIG. 11.

As shown in FIG. 10, grid member 101 is provided with a suitable groove 103 adapted for the insertion of a rod 116 (FIG. 6) being pointed on the lead end and having an opposite threaded end 118 adapted to receive a fastener 121. Wedge washers 122 also may be provided to distribute loading and insure that a sealing fit is achieved.

Figure 12:
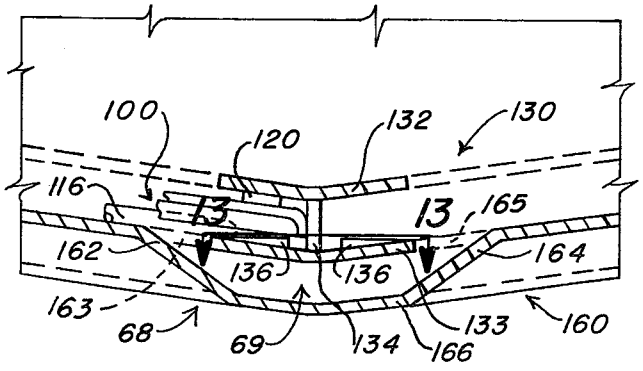
FIG. 12 is a sectional view looking in the direction of the arrows along the line 12—12 in FIG. 11 illustrating the fluidizing header and filter support assembly including camming means to move the filter assembly into operative position.
Figure 13:
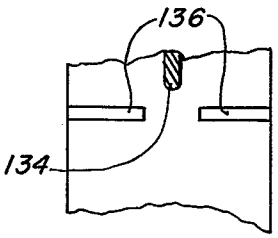
FIG. 13 is a sectional view looking in the direction of the arrows along the line 13—13 in FIG. 12.

In assembly, the filter assembly 100 is slid into the opening between flanges 72 and 74. The filter member slides inwardly and downwardly until it engages filter support assembly 130 shown in FIGS. 11 and 12. Assembly 130 preferably includes a pair of plates 132 and 133 together with a vertical member 134 against which the filter assembly is adapted to abut. As shown in FIGS. 12 and 13 there preferably are provided on plate 133, suitable raised surfaces 136, which will force the filter assembly 100 upwardly so that seal 120 engages plate 132 and/or 134 and a good seal obtained.

After members 100 have been inserted into operative position with the leading edge cammed into the sealed position, rods 116 are inserted into grooves 103 and washers 122 (FIG. 6) inserted to insure that seal 120 is in engagement with the lower body flange on each side around the periphery of the outlet assembly. Seal 76 and cap 78 are then applied, and cap retaining bolts 80 and nuts 118 applied to hold the assembly in place. In future disassembly and assembly operations, rods 116 need not be removed from cap 78.

It will be apparent that when the hopper H is loaded the lading directly engages the filter media in the outlet. The filter media is supported by the grid structure 104 and also by the corrugations 66 in the bottom pan. The filter media alone is not intended to withstand the heavy lading pressure of a full or partly full transportation container or railway hopper.

Figure 14:
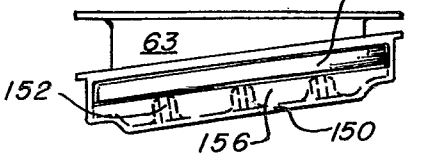
FIG. 14 is a view of an alternative pan construction utilizing vertical ribs to support the filter media instead of the corrugations shown in FIG. 11.

As an alternate to the use of corrugations 66, as shown in FIG. 14, an ordinary pan 150 may be utilized and a series of vertical plates 152 affixed, for example, by welding to the pan 150. The vertical plates 152 engage the filter media 154 and support the same. A gap 156 is provided between the plates for the passage of air to fluidize the lading.

It will be apparent, however, that the use of the corrugations 66 and grid member 101 to support the filter material and provide a plenum for air passage is considerably less expensive than the arrangement shown in FIG. 14.

Lower grid member 101 and frame 112 are structural members and are preferably made of structural material such as steel or aluminum alloy. The outlet frame and bottom pan are also made of structural material such as aluminum, steel or reinforced fiberglass.

In operation, the path of the supply air is through conduit 16, through control valve 20, and at least a portion through inlet conduit 30 into a connection 31 into fluidizing header assembly 68. Fluidizing header assembly 68 comprises a header 69 (FIG. 12) defined by plate 133 and formed member 160 including inclined portions 162 and 164 joined by generally flat portion 166. Header 69 is in fluid communication through openings 163 and 165 with the channels defined by corrugations 66. The air passes longitudinally through header 69 and then transversely through openings 165 into corrugations 66. The air then passes upwardly through each filter assembly and filter media 110 and into the lading to fluidize the lading. The fluidized lading and the air then move transversely back toward header 69 and pass out through discharge conduit 34 with proper control by means of product control valve 36.

It will be apparent to those skilled in the art that the fluidizing outlet assembly may be used in connection with either pneumatic or gravity discharge outlets. In the latter the fluidized lading discharges by gravity to a suitable container or storage bin.

What is claimed is:

1. A fluidizing outlet assembly comprising: an outlet body having upper flange means adapted to mount the outlet assembly on a hopper; said outlet body having a lower body flange on each side of the outlet body; said outlet body further including a bottom pan having an upper pan flange spaced below said lower body flange on each end of the outlet body; said outlet body comprising a unitary member having portions vertically spaced from each other to define longitudinally spaced slots; said bottom pan being inclined downwardly on opposite ends of the outlet body toward an outlet in said body for unloading the lading, and further including a fluidizing header and filter support assembly in the mid portion of said body; said bottom pan comprising means defining a fluidizing plenum in fluid communication with said fluidizing header; said filter support assembly having means adapted to engage and support at least a pair of filter assemblies; each assembly engaging said outlet body on one end of the outlet body and on at least one side of the outlet body; each filter assembly engaging said filter support assembly in the mid portion of said body; each of said filter assemblies comprising a filter member and a lower supporting member; each of said filter assemblies being separately readily removable from said outlet body whereby another filter assembly may be quickly inserted into said outlet body.

2. A fluidizing outlet assembly according to claim 1 wherein each of said filter assemblies comprises a sealing member.

3. A fluidizing outlet assembly according to claim 2 wherein said filter support assembly comprises means for forcing said filter assembly into sealed operative position.

4. A fluidizing outlet assembly according to claim 2 wherein means are provided to urge engagement of the sealing member with the outlet body.

5. A fluidizing outlet assembly according to claim 4 in which said supporting member is provided with a groove on opposite sides thereof and wherein rods are inserted into said grooves to urge engagement of the sealing member with the outlet body.

6. A fluidizing outlet assembly according to claim 5 wherein wedge means are provided to further urge said sealing member into operative sealing position.

7. A fluidizing outlet assembly according to claim 6 wherein said wedge means comprise wedge washers.

8. A fluidizing outlet assembly according to claim 1 wherein said bottom pan comprises corrugations which define said fluidizing plenum through which fluidizing air travels to fluidize the lading and which said corrugations engage and support said filter member.

9. A fluidizing outlet assembly according to claim 8 wherein said plenum is in communication with said fluidizing header and wherein said plenum directs the fluidizing air into contact with said filter member.

10. A fluidizing outlet assembly according to claim 1 wherein said bottom pan is generally flat and generally vertical plates are integrally affixed thereto to define said plenum for fluidizing air to pass through and which plates support said filter member.

11. A fluidizing outlet assembly according to claim 1 wherein said filter support assemblies comprise spaced generally horizontal plates joined by a vertical plate and in operative position said filter assembly engages said spaced horizontal plates and said vertical plates.

12. A fluidizing outlet assembly comprising: an outlet body having upper flange means adapted to mount the outlet assembly on a hopper; said outlet body having a lower body flange on each end of the outlet body; said outlet body further including a bottom pan having an upper pan flange spaced below said lower body flange on each end of the outlet body; said outlet body comprising a unitary member having portions vertically spaced from each other to define longitudinally spaced slots; said bottom pan being inclined downwardly on opposite ends of the outlet body toward an outlet in said body for unloading the lading; a fluidizing header and filter support assembly in the mid portion of said body; said bottom pan comprising corrugations defining a fluidizing plenum in fluid communication with said fluidizing header; said filter support assembly having means adapted to engage and support at least a pair of filter assemblies; each assembly engaging said outlet body and said bottom pan on one end of the outlet and on at least one opposite side of the outlet; each filter assembly engaging said filter support assembly in the mid portion of the outlet; each of said filter assemblies comprising a filter member and a lower supporting member; a seal member mounted on one of said lower body flange and said pair of filter assemblies; each of said filter assemblies being separately readily removable from said outlet body whereby another filter assembly may be readily inserted into said outlet body.

13. A fluidizing outlet assembly according to claim 12 wherein said filter assembly comprises an upper frame member and wherein said seal member is mounted thereon.

* * * * *

UNITED STATES PATENT AND TRADEMARK OFFICE

CERTIFICATE OF CORRECTION

PATENT NO. : 4,015,751

DATED : April 5, 1977

INVENTOR(S) : Dallas W. Rollins et. al.

It is certified that error appears in the above-identified patent and that said Letters Patent are hereby corrected as shown below:

In Column 4, line 37, after "let" insert -- 50 --.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*